US008226024B2

(12) United States Patent
Meillet

(10) Patent No.: US 8,226,024 B2
(45) Date of Patent: Jul. 24, 2012

(54) SELF-RETRACTING LIFELINE WITH RESERVE LIFELINE PORTION

(75) Inventor: Vincent G. Meillet, Cannes la Bocca (FR)

(73) Assignee: D B Industries, Inc., Red Wing, MN (US)

( * ) Notice: Subject to any disclaimer, the term of this patent is extended or adjusted under 35 U.S.C. 154(b) by 331 days.

(21) Appl. No.: 12/751,333

(22) Filed: Mar. 31, 2010

(65) Prior Publication Data

US 2011/0084157 A1 Apr. 14, 2011

Related U.S. Application Data

(60) Provisional application No. 61/251,465, filed on Oct. 14, 2009.

(51) Int. Cl.
*B65H 75/48* (2006.01)
*A62B 35/04* (2006.01)
*B66D 1/34* (2006.01)

(52) U.S. Cl. ..... 242/380; 242/377; 242/382

(58) Field of Classification Search ..... 242/171, 242/371, 377, 379, 379.1, 380, 382, 382.1, 242/382.2, 382.4, 397, 566, 615, 615.3, 140, 242/157 R See application file for complete search history.

(56) References Cited

U.S. PATENT DOCUMENTS

| | | | |
|---|---|---|---|
| 4,877,110 | A | 10/1989 | Wolner |
| 6,019,304 | A | 2/2000 | Skowronski et al. |
| 2008/0035423 | A1 | 2/2008 | Meillet et al. |

FOREIGN PATENT DOCUMENTS

| | | | |
|---|---|---|---|
| FR | 2 927 778 | A1 | 8/2009 |
| WO | WO 2008/008225 | A2 | 1/2008 |
| WO | WO 2008/019354 | A2 | 2/2008 |

OTHER PUBLICATIONS

International Search Report for PCT/US2010/050330 mailed Dec. 8, 2010.

*Primary Examiner* — William E Dondero
(74) *Attorney, Agent, or Firm* — IPLM Group, P.A.

(57) ABSTRACT

A self-retracting lifeline includes a reserve lifeline portion and comprises a housing, a drum rotatably operatively connected to the housing, and a lifeline. A stop member is operatively connected to an intermediate portion a distance from a first end of the lifeline. A bumper portion is operatively connected to the housing and includes a bore through which the lifeline extends, the bore being smaller than the stop member to prevent passage of the stop member through the bore and out of the housing. At least a portion of the bumper portion disconnects from the housing when a predetermined force is exerted on the bumper portion to allow the stop member to exit the housing.

15 Claims, 16 Drawing Sheets

FIG. 8
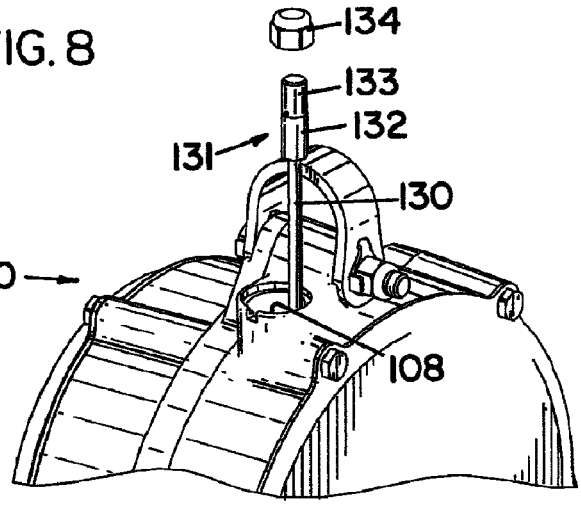
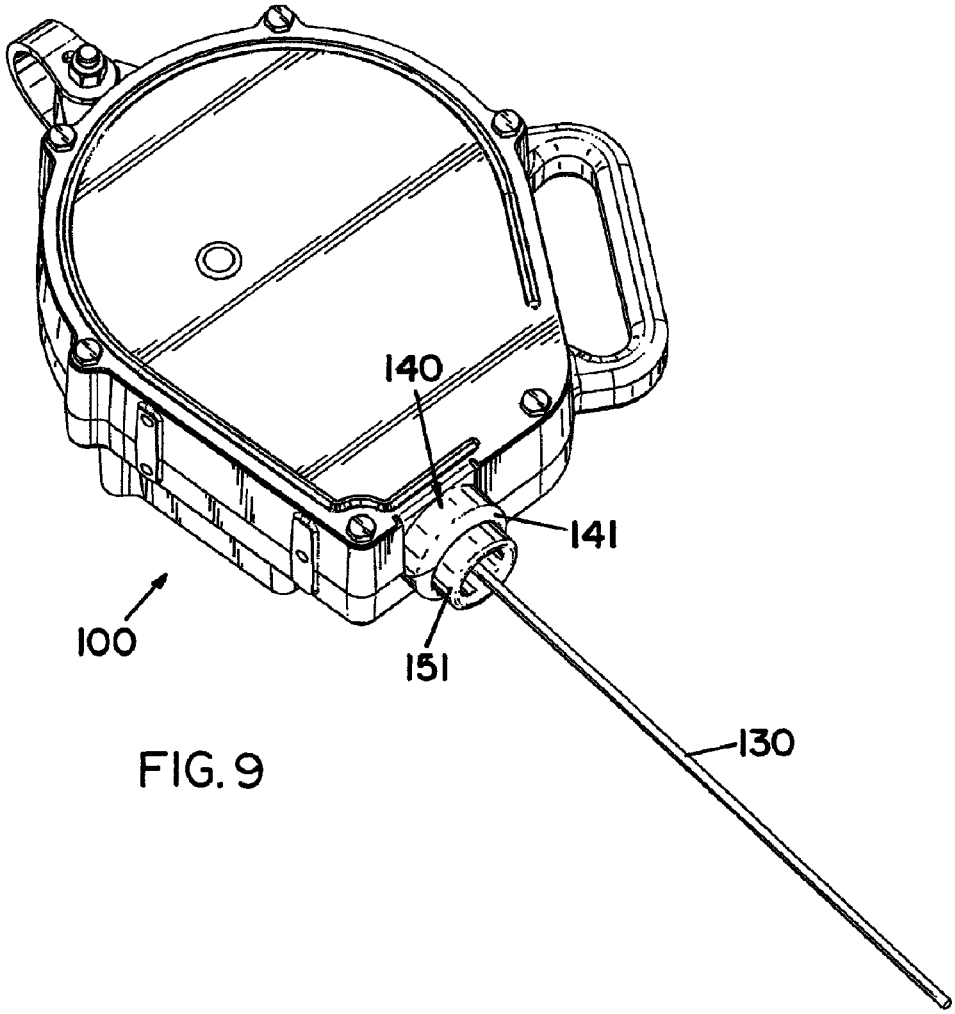
FIG. 9

FIG. 16
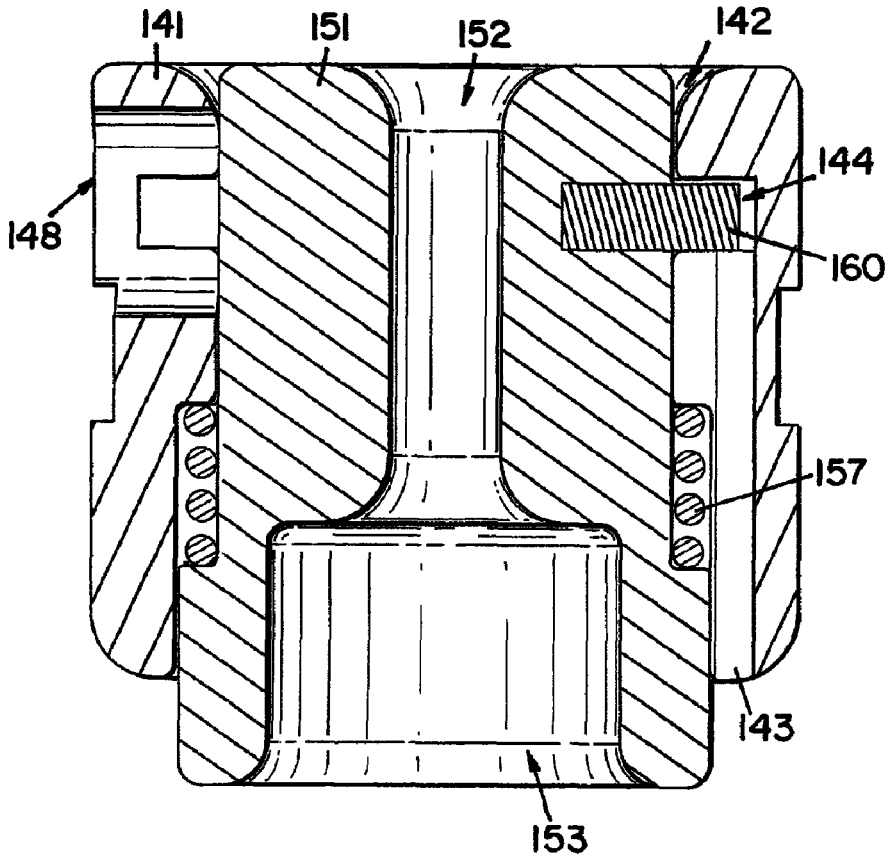
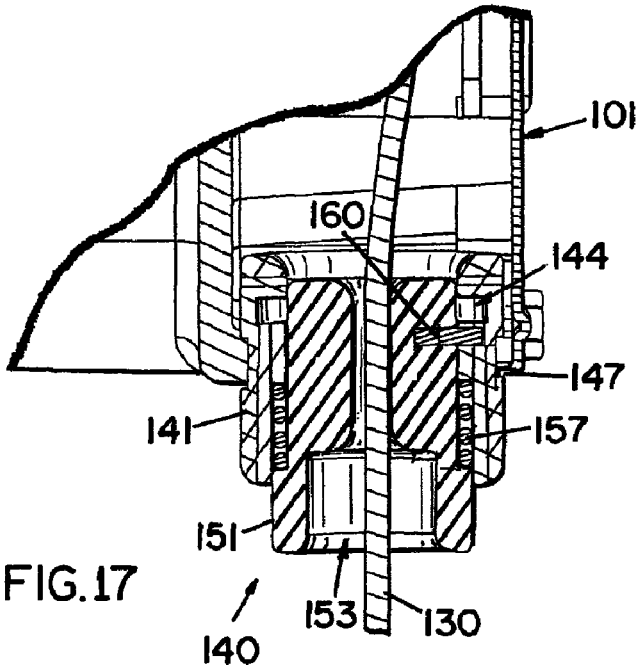
FIG. 17

SELF-RETRACTING LIFELINE WITH RESERVE LIFELINE PORTION

This application claims the benefit of U.S. Provisional Patent Application Ser. No. 61/251,465 filed on Oct. 14, 2009.

FIELD OF THE INVENTION

The present invention relates to a self-retracting lifeline with a reserve lifeline portion.

BACKGROUND

Various occupations place people in precarious positions at relatively dangerous heights thereby creating a need for fall arrest, fall protection, and rescue equipment. Among other things, such equipment usually includes a lifeline interconnected between a support structure and a person working in proximity to the support structure. The lifeline is typically secured to a full-body safety harness worn by the user.

Self-retracting lifelines are commonly used by workers performing tasks during which there is a risk a fall may occur. A self-retracting lifeline generally includes a housing containing a drum around which a lifeline such as cable, rope, or webbing is wound. The drum is spring biased to pay out the lifeline as tension pulling the lifeline is applied and to retract the lifeline that has been unwound from the drum as the tension on the lifeline is reduced or released. The housing also includes a brake assembly for stopping rotation of the drum when the lifeline suddenly unwinds from the drum at a rate greater than a predetermined maximum angular velocity.

A self-retracting lifeline is typically connected to a support structure within the vicinity the worker is performing the task, and an end of the lifeline is typically connected to a safety harness worn by the worker. The lifeline is easily drawn out of the self-retracting lifeline housing as the worker moves away from the device, and the lifeline is automatically drawn back into the housing as the worker moves toward the device. Should a fall occur, the brake assembly within the device is automatically engaged by a centrifugal clutch assembly, which gradually and quickly stops the worker's fall by gradually and quickly stopping the rotation of the drum. As the rotation of the drum is stopped, additional lifeline is prevented from being paid out of the housing to stop the fall of the worker.

A self-retracting lifeline could also include a retrieval assembly, which retracts or pays out the lifeline of the self-retracting lifeline, to raise or lower the worker to a safe location should a fall occur.

Through use, the lifeline could become worn, and the integrity of the self-retracting lifeline could become compromised therefore compelling replacement of the lifeline to optimize safety. Some self-retracting lifelines require that the entire device be sent in for repair to replace the lifeline while some self-retracting lifelines are "field-replaceable" because the lifelines can be replaced by the worker.

For the reasons stated above and for other reasons stated below, which will become apparent to those skilled in the art upon reading and understanding the present specification, there is a need in the art for a self-retracting lifeline with a reserve lifeline portion.

SUMMARY

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, a self-retracting lifeline comprises a housing, a drum, a lifeline, a stop member, and a bumper portion. The drum is rotatably operatively connected to the housing. The lifeline has a first end operatively connected to the drum, an intermediate portion windable about the drum, and a second end. The stop member is operatively connected to the intermediate portion a distance from the first end. The bumper portion is operatively connected to the housing and includes a bore through which the lifeline extends. The bore is smaller than the stop member to prevent passage of the stop member through the bore and out of the housing. At least a portion of the bumper portion disconnects from the housing when a force of at least 450 pounds is exerted on the bumper portion to allow passage of the stop member out of the housing.

In one embodiment, a self-retracting lifeline comprises a housing, a drum, a lifeline, a stop member, and a bumper portion. The drum is rotatably operatively connected to the housing. The lifeline has a first end operatively connected to the drum, an intermediate portion windable about the drum, and a second end. The stop member is operatively connected to the intermediate portion a distance from the first end. The bumper portion is operatively connected to the housing. The bumper portion includes an outer portion operatively connected to the housing and an inner portion operatively connected to the outer portion. The outer portion has a first bore configured and arranged to receive the inner portion, and the inner portion has a second bore through which the lifeline extends. The stop member is smaller than the first bore and larger than the second bore. The inner portion disconnects from the outer portion when a force of at least 450 pounds is exerted on the inner portion to allow passage of the stop member out of the housing.

In one embodiment, a self-retracting lifeline comprises a housing, a drum, a lifeline, a stop member, a bumper portion, a pin, and a biasing member. The drum is rotatably operatively connected to the housing. The lifeline has a first end operatively connected to the drum, an intermediate portion windable about the drum, and a second end. The stop member is operatively connected to the intermediate portion a distance from the first end. The bumper portion is operatively connected to the housing. The bumper portion includes an outer portion operatively connected to the housing and an inner portion operatively connected to the outer portion. The outer portion has a first bore configured and arranged to receive the inner portion, and the inner portion has a second bore through which the lifeline extends. The stop member is smaller than the first bore and larger than the second bore. The inner portion disconnects from the outer portion when a force of at least 450 pounds is exerted on the inner portion to allow passage of the stop member out of the housing. The pin connects the outer portion and the inner portion, and the pin breaks to disconnect the outer portion and the inner portion. The spring places a biasing force on the outer portion and the inner portion and exerts a downward force on the inner portion relative to the outer portion, wherein the spring absorbs energy from an upward force placed on the inner portion.

BRIEF DESCRIPTION OF THE DRAWINGS

The present invention can be more easily understood, and further advantages and uses thereof can be more readily apparent, when considered in view of the detailed description and the following Figures in which:

FIG. 8 is a perspective view of the self-retracting lifeline shown in FIG. 1 showing the lifeline extending through a top portion with a stop member removed;

FIG. 9 is a bottom perspective view of the self-retracting lifeline shown in FIG. 1;

FIG. 16 is a cross-sectional view of the bumper portion shown in FIG. 10 during assembly;

FIG. 17 is a partial cross-sectional view of the self-retracting lifeline showing the connection of the housing and the bumper portion;

In accordance with common practice, the various described features are not drawn to scale but are drawn to emphasize specific features relevant to the present invention. Reference characters denote like elements throughout the Figures and the text.

DETAILED DESCRIPTION OF A PREFERRED EMBODIMENT

Figure 1:
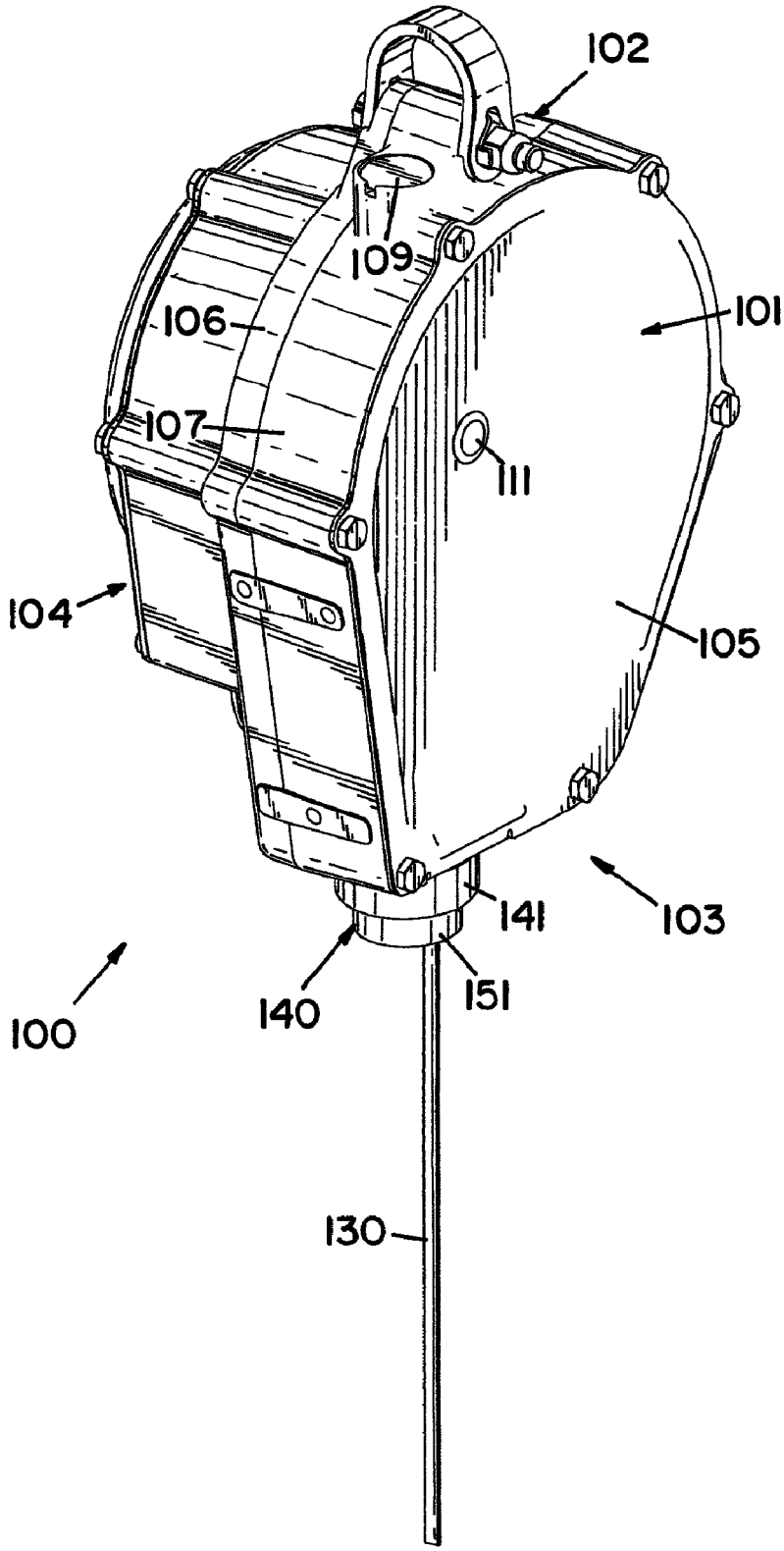
FIG. 1 is a perspective view of a self-retracting lifeline constructed in accordance with the principles of the present invention.

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

An embodiment self-retracting lifeline constructed in accordance with the principles of the present invention is designated by the numeral 100 in the drawings. The self-retracting lifeline 100 includes a housing 101 having a top portion 102, a bottom portion 103, a first side 104, and a second side 105. The housing 101 comprises a first housing portion 106 and a second housing portion 107, which fit together to form a cavity 115 therebetween in which other components of the self-retracting lifeline are housed. The second housing portion 107 includes a top bore 108, a side bore 110, and a bottom aperture 112. A top cover portion 109 is configured and arranged to cover the top bore 108, and a side cover portion 111 is configured and arranged to cover the side bore 110.

The self-retracting lifeline 100 is similar to the ULTRA-LOK RSQ self-retracting lifeline, Part No. 3504550, manufactured by D B Industries, Inc. d.b.a. Capital Safety USA of Red Wing, Minn., but it is recognized that the embodiments of the present invention could be used with any suitable self-retracting lifeline or safety device.

A drum 118 is rotatably connected to the housing 101 within the cavity 115 by means well known in the art. The drum 118 includes a base 119 about which a lifeline 130 is wound and flanges 120 and 121 extending outward from opposing sides of the base 119 to keep the lifeline on the base 119. The base 119 includes a receiver portion 116, which is cylindrical-shaped with a threaded bore extending longitudinally therethrough, configured and arranged to receive a set screw 125 or other suitable locking member. The threaded bore of the receiver portion 116 mates with the threads of the set screw 125. The set screw 125 includes a tool receiver 126, which is hexagonal shaped to receive an alien wrench or similar tool. The tool receiver 126 could be any shape configured and arranged to receive any suitable tool. When the drum 118 is in a select position, the receiver portion 116 of the drum 118 aligns with a receiving bore 117 in the housing. The receiving bore 117 is located in the inside wall separating the drum compartment and the sealed compartment. The drum 118 and the housing 101, when in the select position and when the lifeline 130 is unwound from the drum 118, form a channel 122 through which the lifeline 130 can be threaded. The channel portion of the drum 118 is hexagonal shaped and includes a shoulder portion 123 extending into the channel portion.

The lifeline 130 includes a first end 131 to which a connector 132 is operatively connected by means well known in the art. Extending upward from the connector 132 is a threaded end 133 onto which a stop member 134, shown as a hexagonal nut, is threaded. The stop member 134 includes a nylon ring (not shown) to assist in tightening and locking the stop member 134 on the threaded end 133. The connector 132, although not shown, is hexagonal-shaped to assist in tightening the stop member 134 thereon and the channel portion of the drum 118 has a corresponding shape to assist in preventing rotation of the connector 132 and the stop member 134, which reduces the risk the stop member 134 will loosen.

Figure 3:
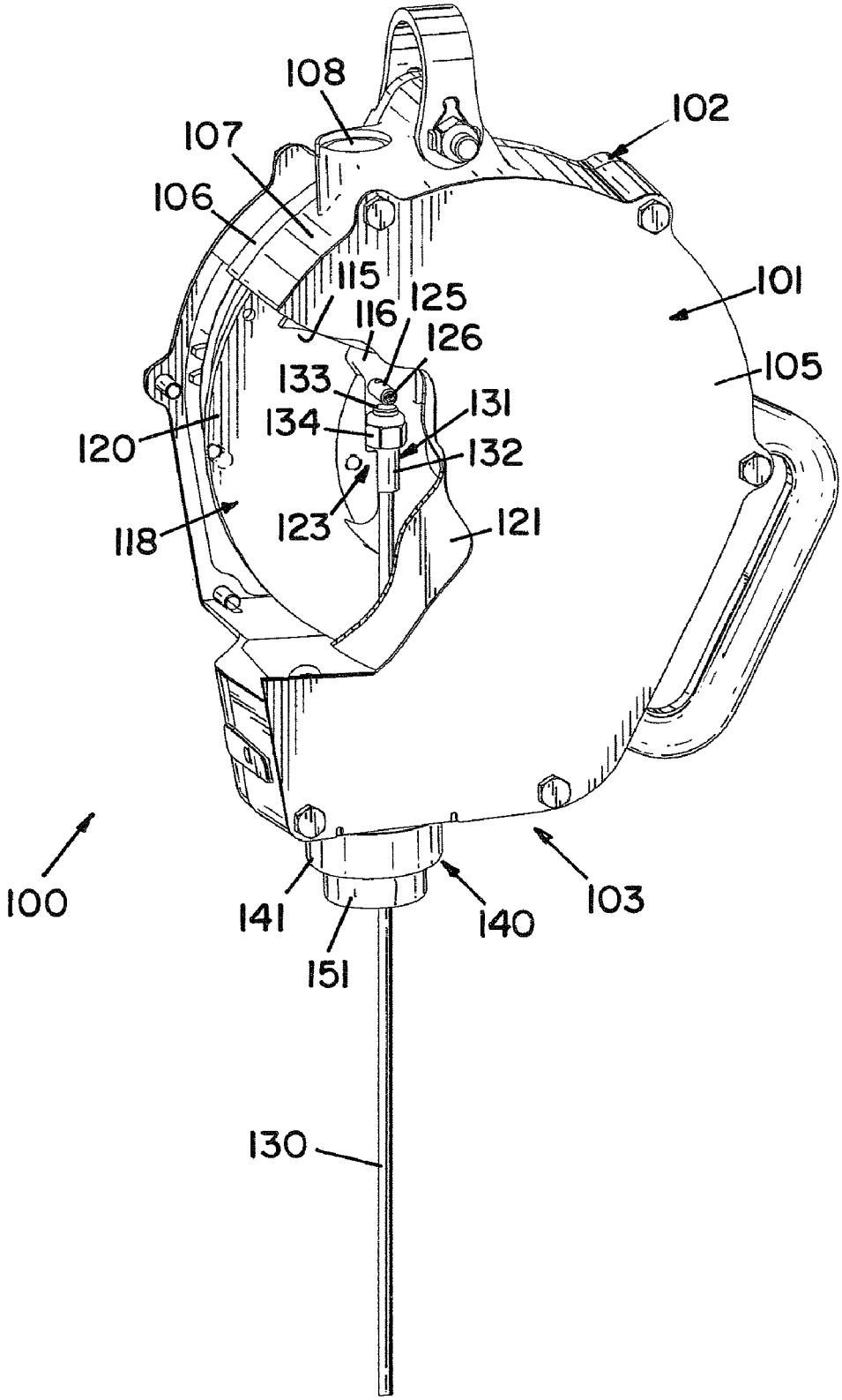
FIG. 3 is a perspective view of the self-retracting lifeline shown in FIG. 1 with a portion removed showing an end of the lifeline and a fastener in a locked position.
Figure 4:
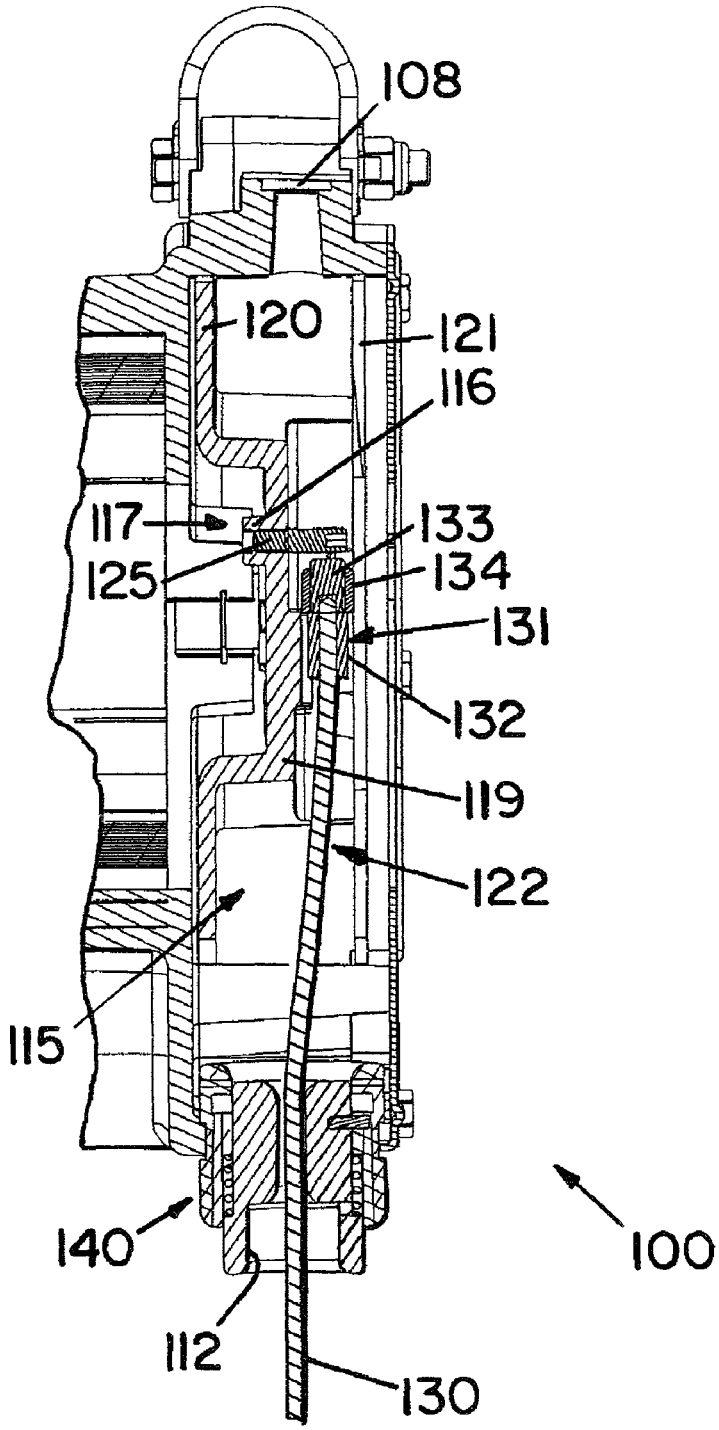
FIG. 4 is a partial cross-sectional view of the self-retracting lifeline shown in FIG. 1 showing the fastener in a locked position.

When assembled for use, as shown in FIGS. 3 and 4, the shoulder portion 123 of the drum 118 is configured and arranged to support the bottom of the stop member 134 proximate the connector 132. The set screw 125 is positioned so that it extends into the channel portion of the drum 118 proximate the top of the threaded end 133. Thus, the stop member 134 operatively connected to the first end 131 of the lifeline 130 is sandwiched between the shoulder portion 123 and the set screw 125 and between the base 119 and the second flange 121 of the drum 118. This arrangement prevents the first end 131 of the lifeline 130 from becoming disengaged from the drum 118. An intermediate portion 135 of the lifeline 130 is wound about and paid out from the base 119. The lifeline 130 also includes a second end 136 to which a snap hook 166 is connected for connecting the lifeline 130 to a safety harness (not shown), which is well known in the art.

A bumper portion 140 is operatively connected to the housing 101 proximate the bottom aperture 112. The bumper portion 140 includes an outer portion 141 and an inner portion 151. The outer portion 141 is operatively connected to the housing 101, and the inner portion 151 is operatively connected to the outer portion 141.

Figure 11:
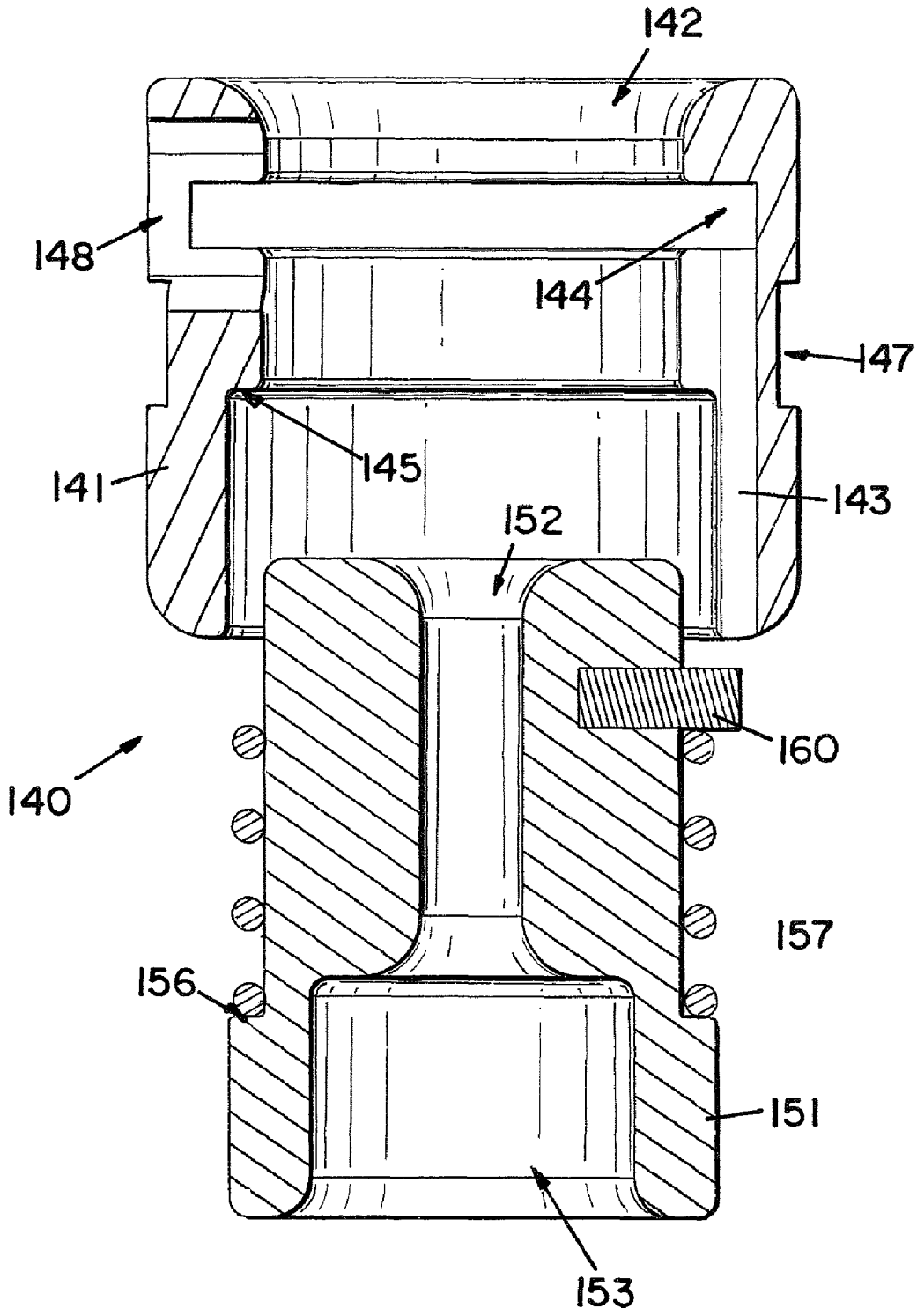
FIG. 11 is cross-sectional exploded view of the bumper portion shown in FIG. 10.

The outer portion 141 includes a bore 142 extending longitudinally therethrough and a longitudinal slot 143 in the inner surface accessible through the bore 142. The slot 143 extends from the bottom to proximate a middle of the outer portion 141, as shown in FIG. 11. Proximate the top of the slot 143 and the top of the outer portion 141 is a receptacle portion 144, which is like a lateral detent in the inner surface of the outer portion 141. Proximate a side of the outer portion 141 opposite the slot 143 is an opening 148 extending longitudinally proximate the receptacle portion 144. Below the receptacle portion 144, proximate the middle of the outer portion 141, is a shoulder portion 145 where the bore 142 widens to the bottom of the outer portion 141. Thus, the top of the bore 142 is smaller than the bottom of the bore 142. Proximate the middle of the outer portion 141, the outer surface includes a lateral notch 147. The notch 147 is configured and arranged to receive portions of the housing 101, as shown in FIG. 17.

The inner portion 151 includes a bore 152 extending longitudinally therethrough that is smaller proximate the top and wider proximate the bottom, and the wider portion forms a lifeline bumper receptacle 153 configured and arranged to receive a portion of a lifeline bumper 165 proximate the second end 136 of the lifeline 130 to which the snap hook 166 is connected. Proximate the bottom of the inner portion 151, the outer surface includes a shoulder 156, and a pin 160 is operatively connected and extends outward from the side of the inner portion 151 proximate the top. A biasing member such as a spring 157 is positioned between the shoulder 156 and the pin 160.

Figure 13:
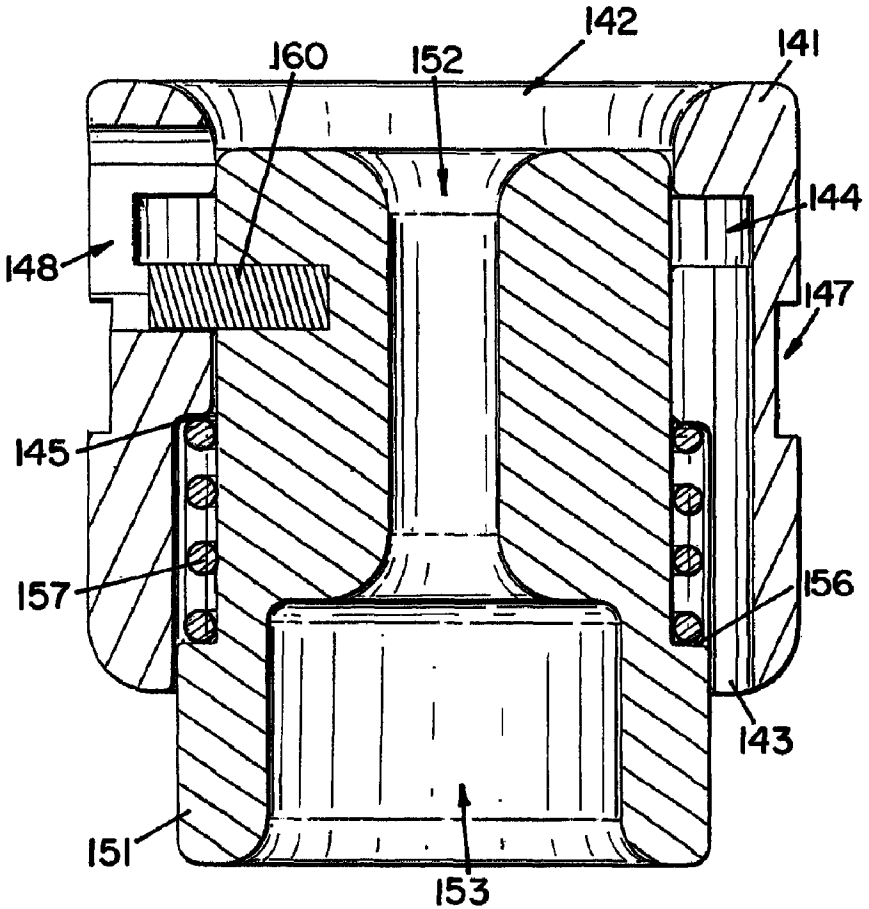
FIG. 13 is a cross-sectional view of the bumper portion shown in FIG. 12 rotated ninety degrees.
Figure 12:
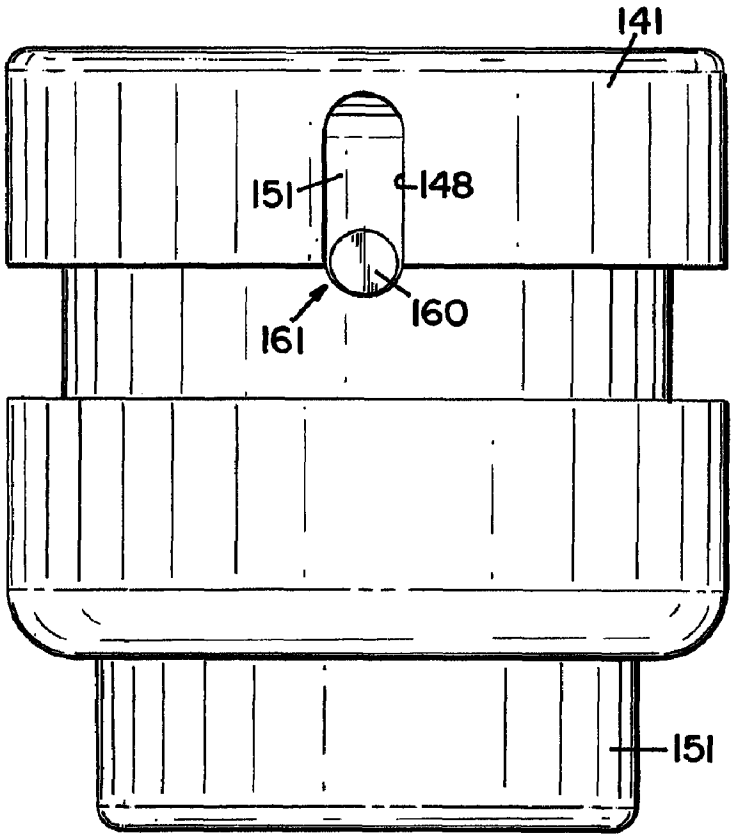
FIG. 12 is a side view of the bumper portion shown in FIG. 10 assembled in a lower position.
Figure 15:
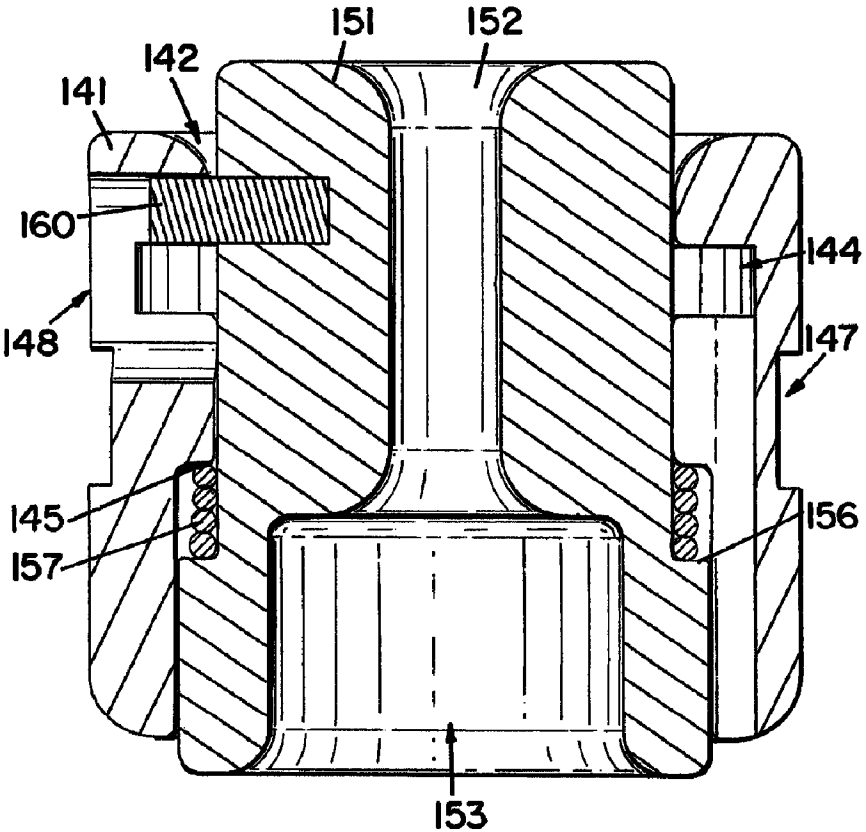
FIG. 15 is a cross-sectional view of the bumper portion shown in FIG. 14 rotated ninety degrees.
Figure 14:
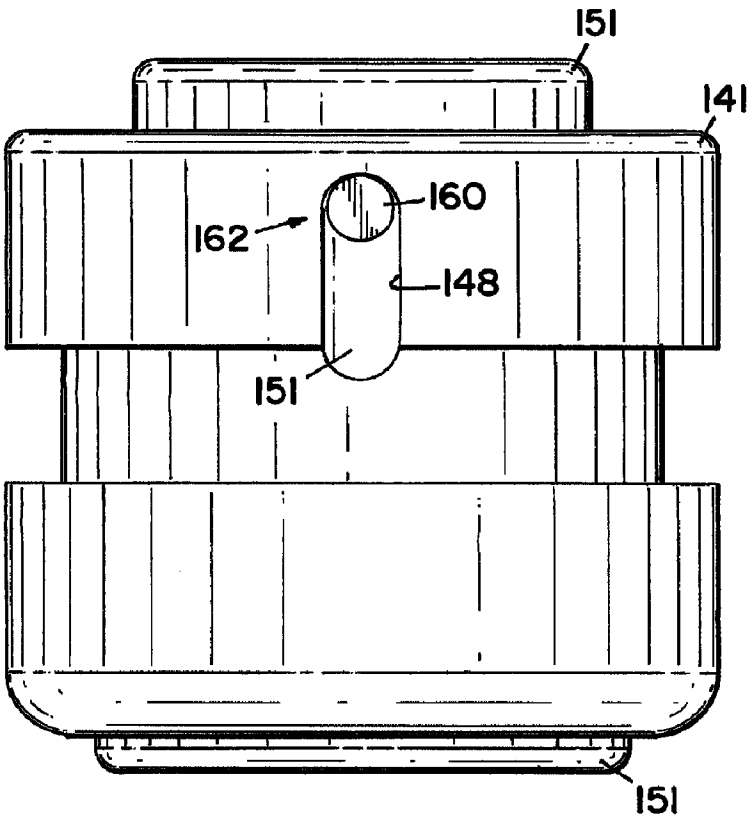
FIG. 14 is side view of the bumper portion shown in FIG. 10 assembled in an upper position.

To connect the inner portion 151 to the outer portion 141, the pin 160 is aligned with the slot 143 as shown in FIG. 11. The inner portion 151 is then inserted into the outer portion 141 until the pin 160 is proximate the receptacle portion 144 as shown in FIG. 16. The inner portion 151 is then rotated approximately 180 degrees until the pin 160 is proximate the opening 148. The pin 160 connects the inner portion 151 to the outer portion 141. The spring 157 is positioned between the shoulder 156 of the inner portion 151 and the shoulder 145 of the outer portion 141, and because the outer portion 141 is fixed relative to the housing 101, the spring 157 exerts a downward force on the inner portion 151, thus positioning the inner portion 151 and the pin 160 in a lower position 161, shown in FIGS. 12 and 13. Should an upward force be exerted upon the inner portion 151, such as when the lifeline is retracted into the housing and the lifeline bumper 165 contacts the inner portion 151, the force of the spring 157 is overcome and the inner portion 151 and the pin 160 are positioned in an upper position 162, shown in FIGS. 14 and 15. The spring 157 then biases the inner portion 151 back into the lower position 161. This provides some cushion to absorb some of the energy upon impact and reduce possible damage to the lifeline. Because two actions are needed to disengage the inner portion 151 from the outer portion 141, pushing upward on the inner portion 151 and rotating the inner portion 151, it is unlikely that the inner portion 151 would be accidentally disengaged from the outer portion 141.

Figure 18:
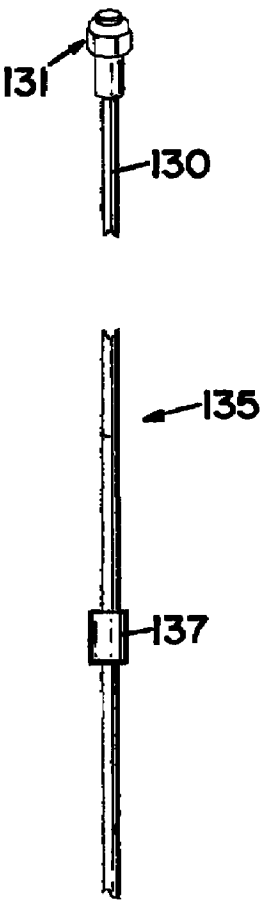
FIG. 18 is a perspective view of a lifeline for use with the self-retracting lifeline shown in FIG. 1.
Figure 21:
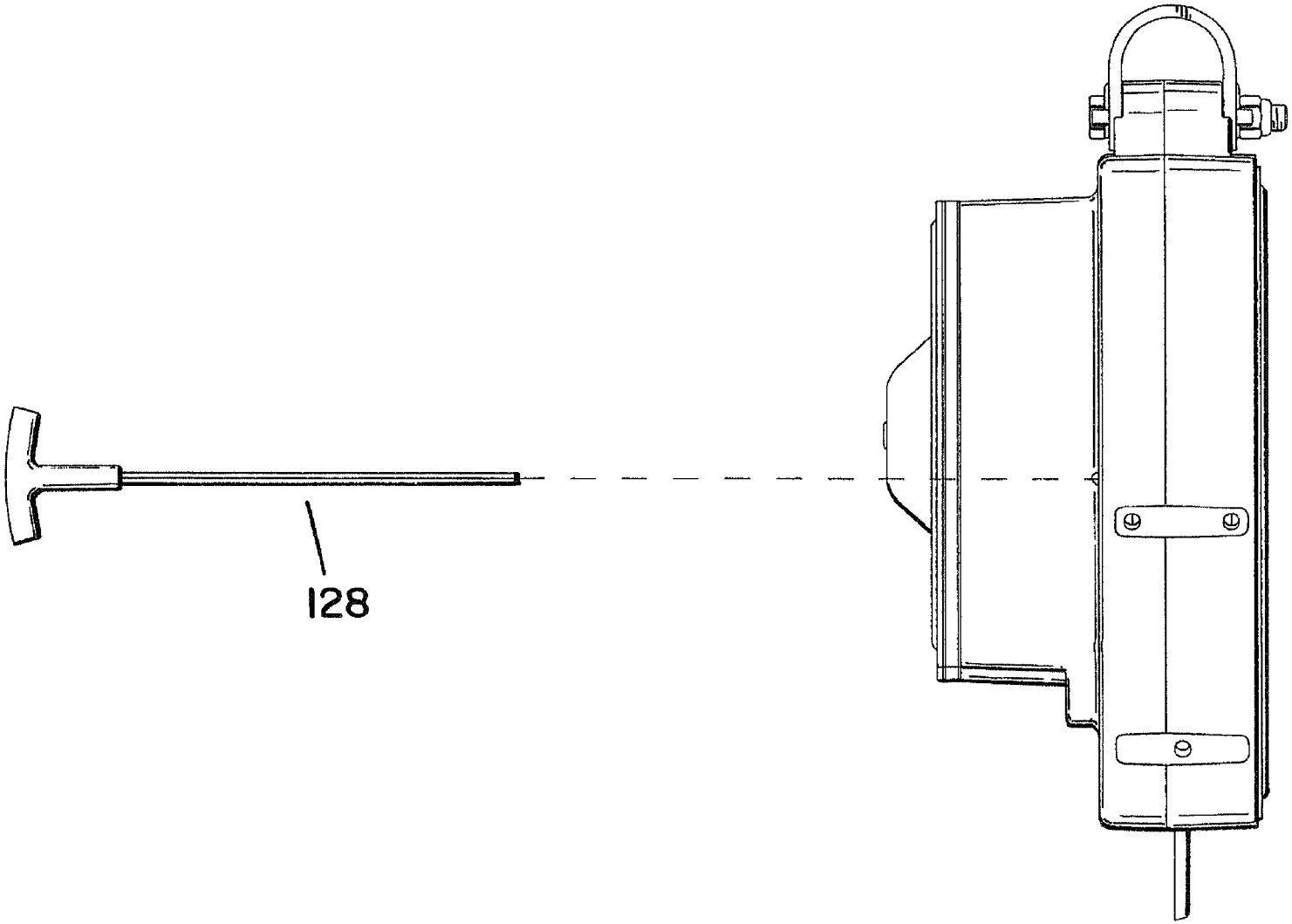
FIG. 21 is a side view of the self-retracting lifeline shown in FIG. 19 with a tool exploded away from the housing.

An additional stop member 137 could be operatively connected to the intermediate portion 135 of the lifeline 130 approximately two to four feet from the first end 131 to provide a reserve portion of lifeline. As shown in FIG. 18, the stop member 137 is a cylindrical member swaged on the lifeline 130 and is small enough, approximately 0.5 inches in diameter, so that it can be wound about the drum and does not interfere with the other lifeline portions wound about the drum. The stop member 137 is larger than the top of the bore 152 so that it cannot pass through the inner portion 151. Should a fall occur when a majority of the lifeline is paid out from the drum, the reserve portion could be used to ensure a safe fall arrest. The force of the stop member 137 exerts pressure proximate the top of the inner portion 151, and the force breaks the pin 160, disconnecting the inner portion 151 from the outer portion 141, thereby allowing the reserve portion of lifeline to be paid out from the drum because the inner portion 151 no longer prevents the stop member from being pulled out of the housing 101. Preferably, a force of at least 450 pounds is needed to break the pin 160.

Figure 2:
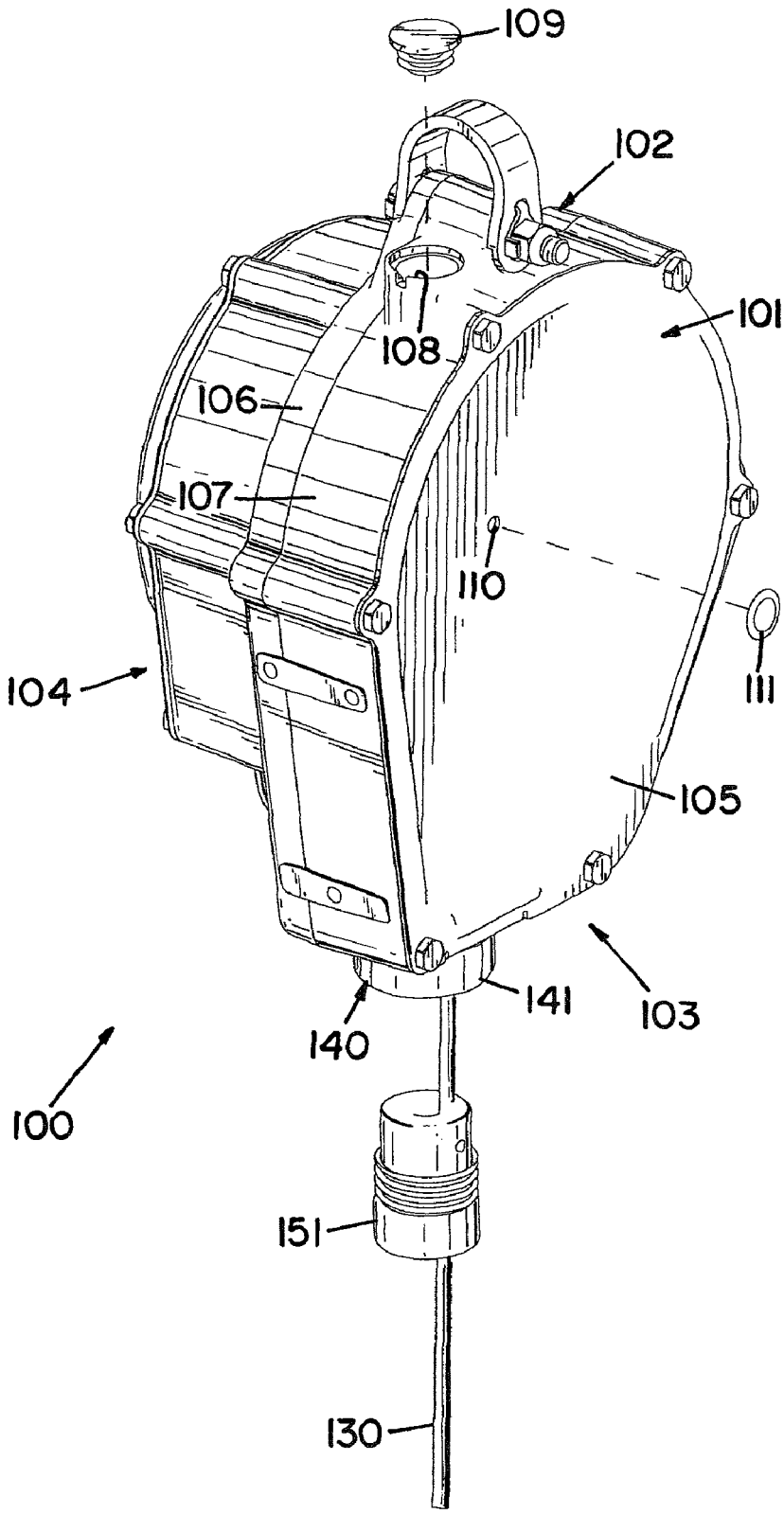
FIG. 2 is a perspective view of the self-retracting lifeline shown in FIG. 1 with covers removed.

Should the lifeline 130 become damaged, the lifeline 130 can be easily replaced in the field. To replace the lifeline 130, the top cover portion 109 and the side cover portion 111 are removed to allow access to the housing cavity 115, as shown in FIG. 2. The lifeline 130 is paid out from the housing 101 so that the lifeline 130 is substantially paid out and straight, without being wound about the drum 118, as shown in FIGS. 3 and 4, and the bore of the set screw receiver portion 116 aligns with the receiving bore 117 of the housing 101.

Figure 20:
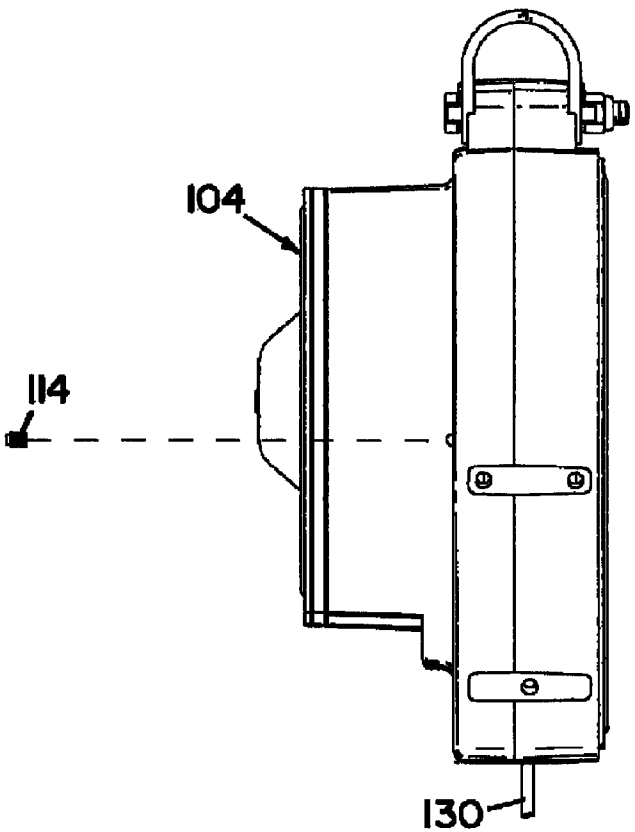
FIG. 20 is a side view of the self-retracting lifeline shown in FIG. 19 with a cover exploded away from the housing.
Figure 19:
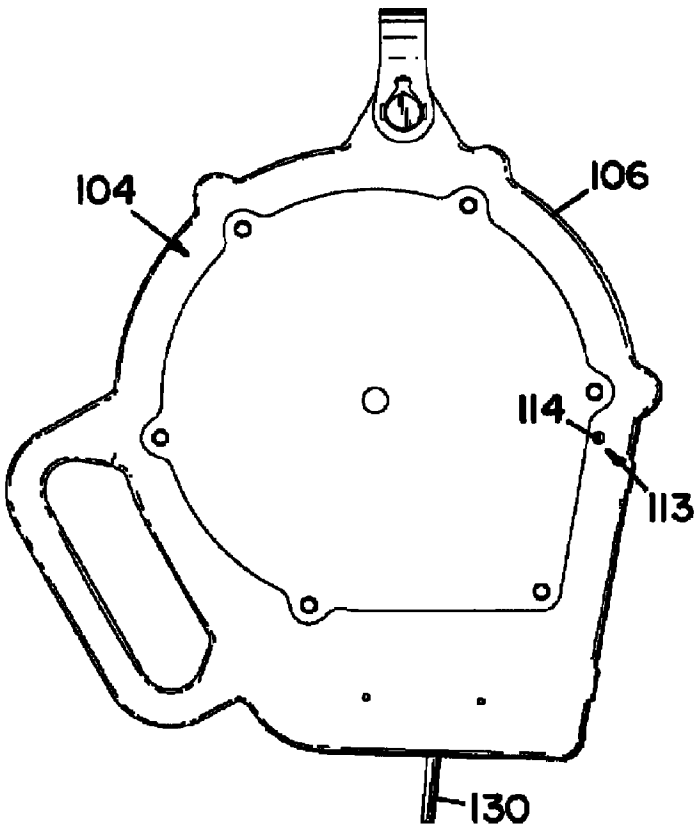
FIG. 19 is a first side view of the self-retracting lifeline shown in FIG. 1.
Figure 23:
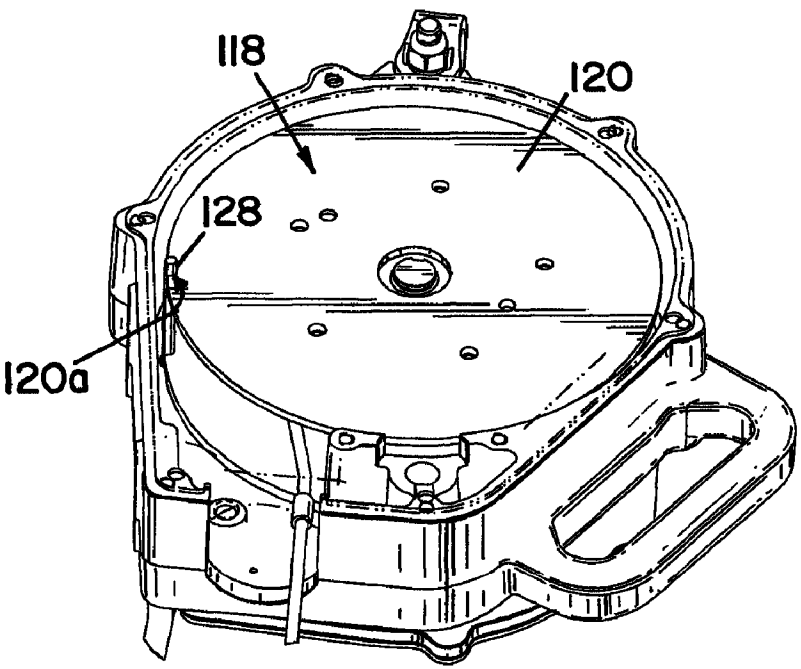
FIG. 23 is a perspective view of the self-retracting lifeline shown in FIG. 19 with the first side of the housing removed.
Figure 22:
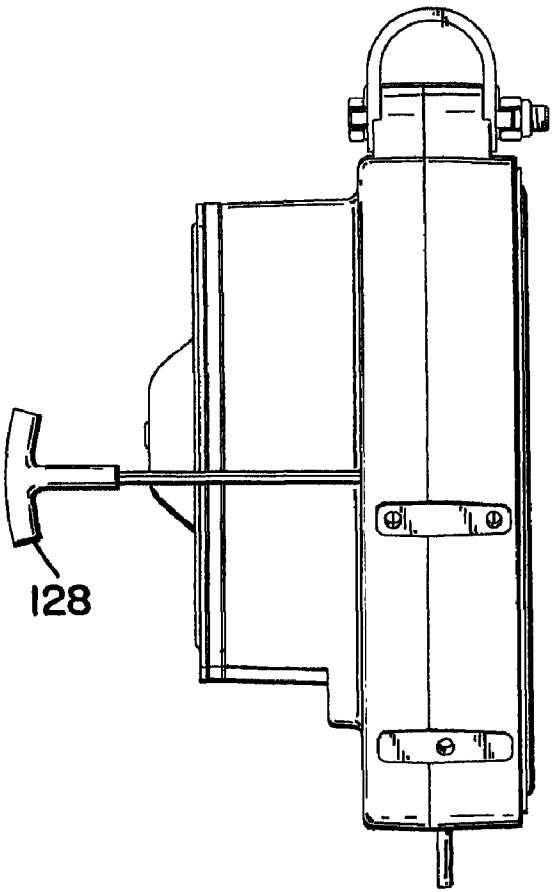
FIG. 22 is a side view of the self-retracting lifeline shown in FIG. 21 with the tool inserted into the housing.

To assist in keeping the drum 118 from rotating during the lifeline replacement process, a tool 128 such as an alien wrench is inserted through a bore 113 in the first housing portion 106 and into an aperture **120*a* in the first flange 120 of the drum 118. This is shown in FIGS. 19-23. As shown in FIG. 20, a cover 114 is first removed from the bore 113 to allow access to the bore 113. Although only one aperture 120*a* is shown in FIG. 23, a plurality of apertures 120*a* could be included to ensure the lifeline 130 is substantially paid out from the drum 118. The tool 128** allows the user to perform the remaining steps of the lifeline replacement process without having to hang onto the lifeline to prevent the drum from rotating.

Figure 5:
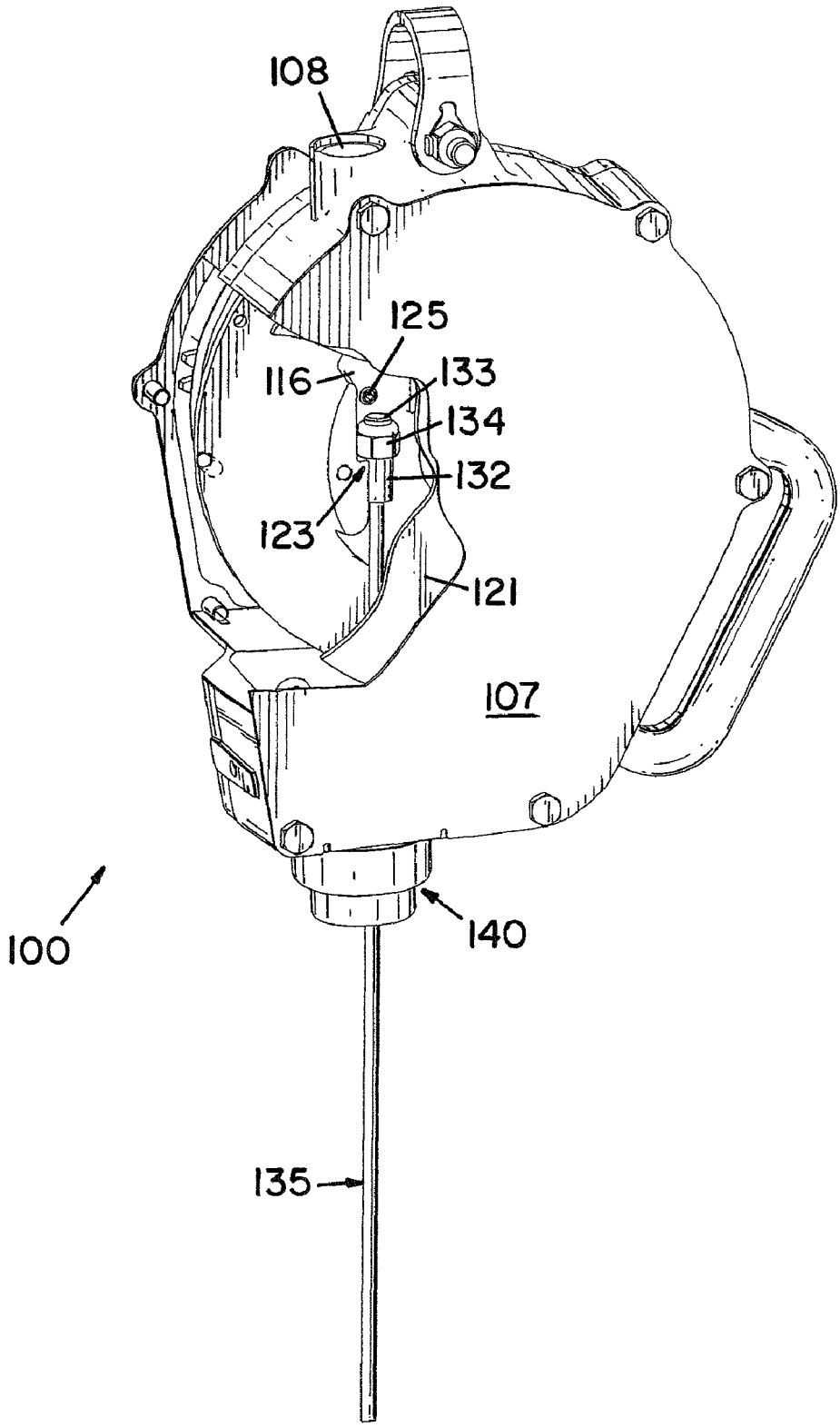
FIG. 5 a perspective view of the self-retracting lifeline shown in FIG. 1 with a portion removed showing the end of the lifeline and the fastener in an unlocked position.
Figure 6:
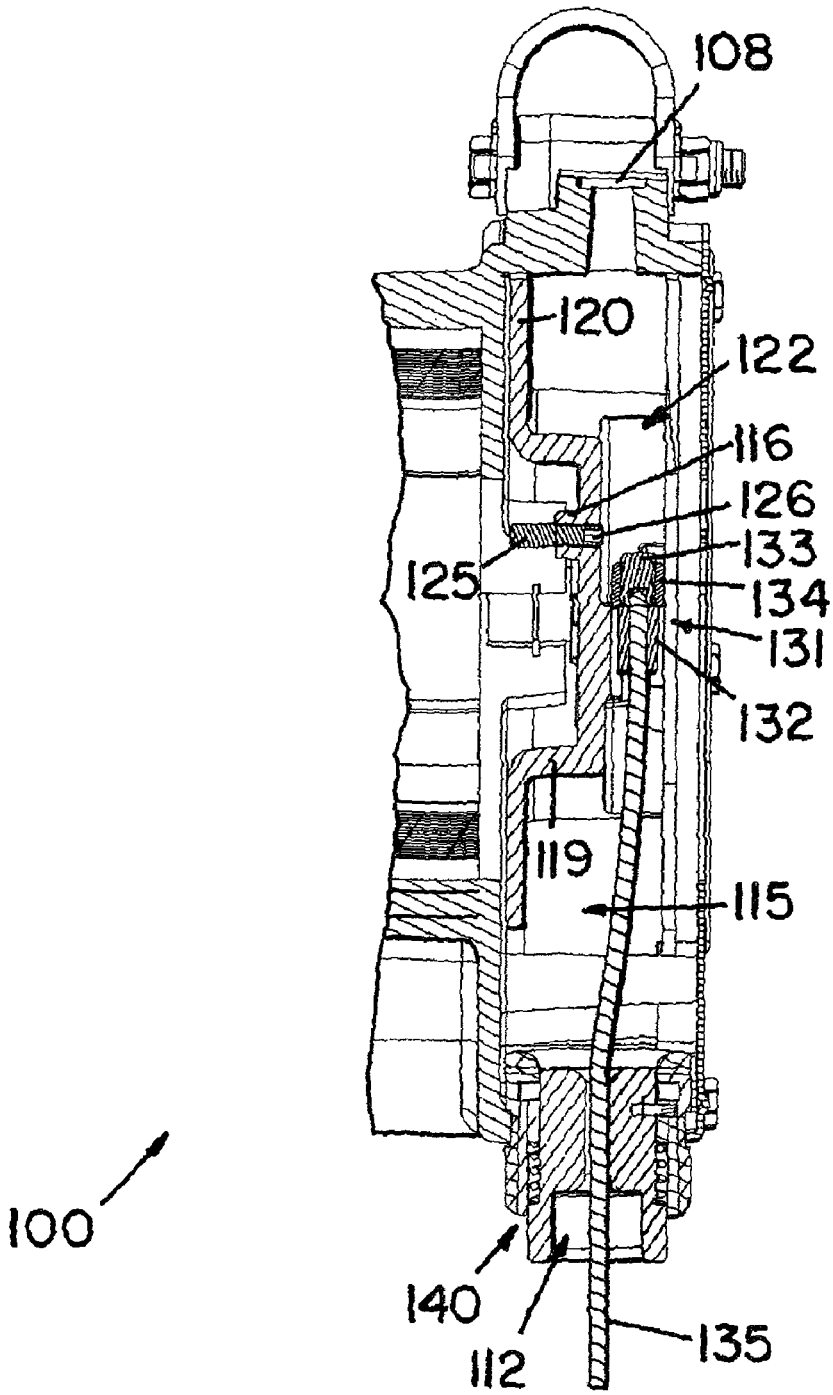
FIG. 6 is a partial cross-sectional view of the self-retracting lifeline shown in FIG. 1 showing the fastener in the unlocked position.

Another tool (not shown) such as an alien wrench is inserted through the side bore 110 and into the tool receiver 126 of the set screw 125. The tool is then rotated to move the set screw 125 into the receiving bore 117 of the housing 101, which locks the drum 118 thereby preventing the drum 118 from rotating. As shown in FIGS. 5 and 6, the set screw 125 does not extend into the channel portion of the drum 118 and thus does not prevent the first end 131 of the lifeline 130 from being moved in an upward direction.

Figure 7:
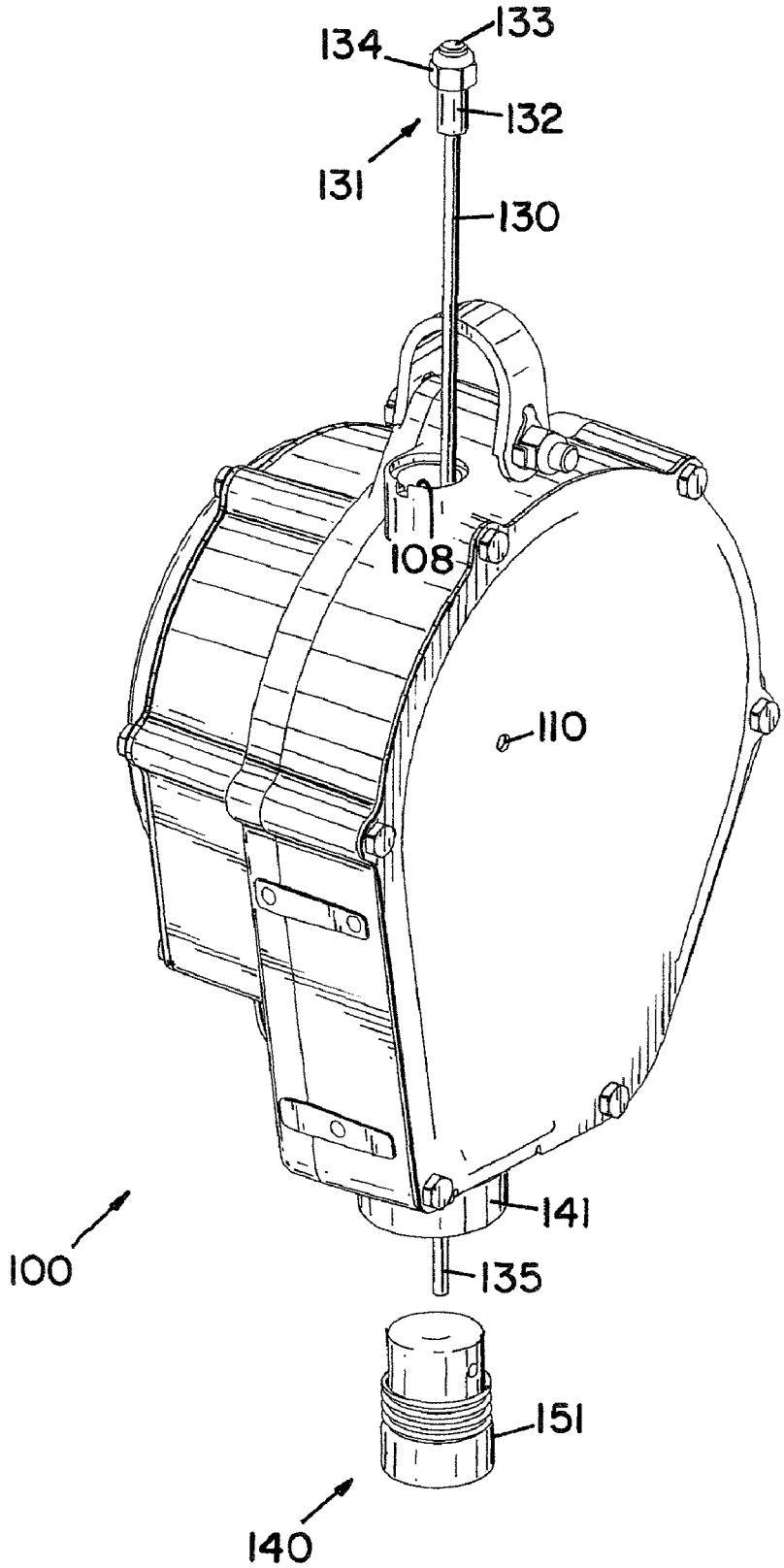
FIG. 7 is a perspective view of the self-retracting lifeline shown in FIG. 1 showing the lifeline extending through a top portion.
Figure 10:
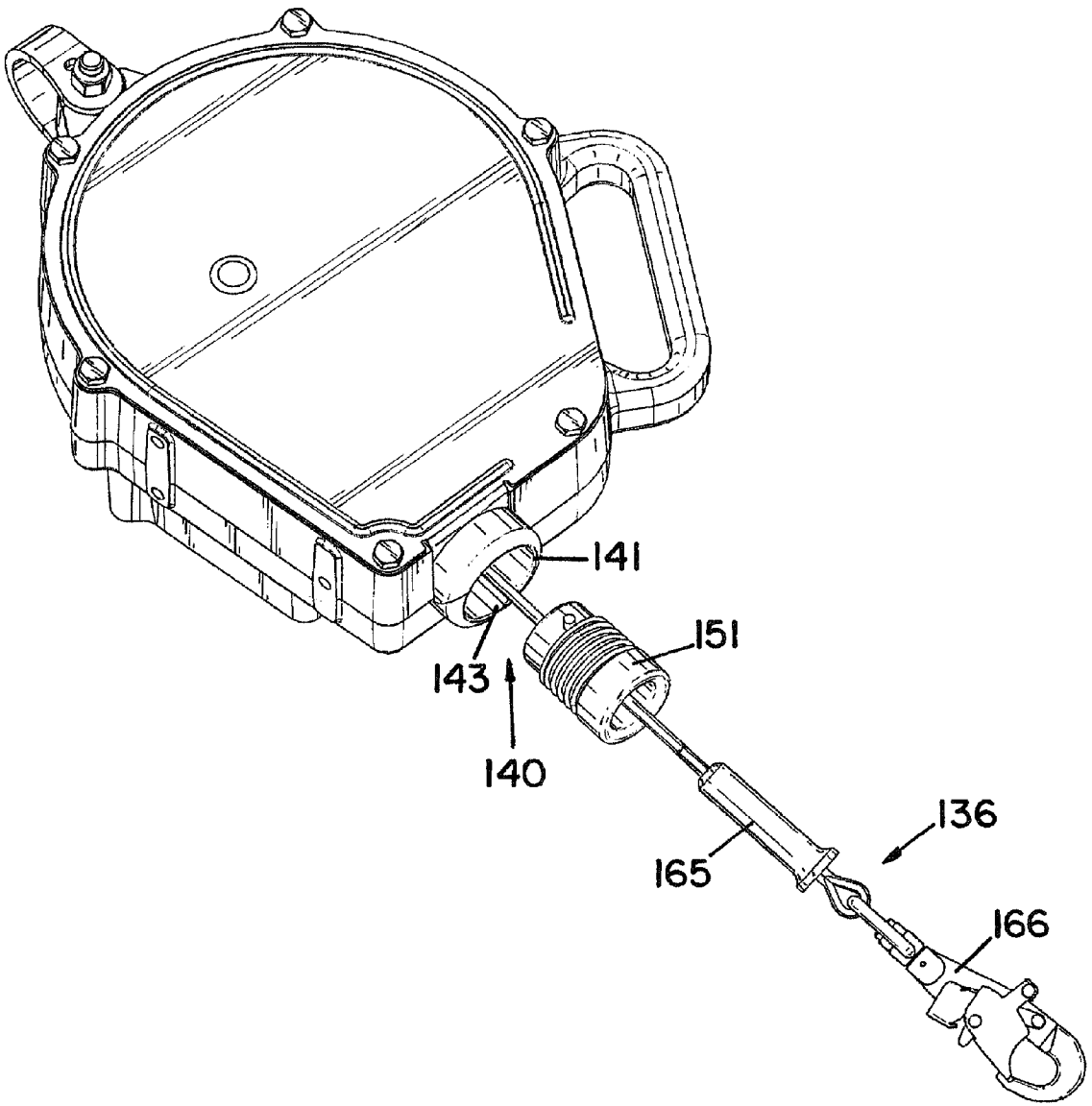
FIG. 10 is a partial exploded bottom perspective view of the self-retracting lifeline shown in FIG. 9 showing a bumper portion.

After the drum 118 is locked and the set screw 125 does not hinder movement of the lifeline 130, the lifeline 130 is pushed in an upward direction from proximate the bottom of the housing 101, and the first end 131 is threaded through the channel 122 and through the top bore 108, as shown in FIG. 7. Then, as shown in FIG. 8, the stop member 134 is removed from the threaded end 133. The lifeline 130 is then pulled in a downward direction so that the first end 131 is threaded through the top bore 108, through the channel 122, through the bottom aperture 112, and through the bumper portion 140. Because the stop member 134 has been removed, the first end 131 can move past the shoulder portion 123. The inner portion 151 of the bumper portion 140 can be removed by rotating the pin 160 to align with the slot 143 and then pulling the inner portion 151 downward. This creates a larger opening through which the first end 131 can be pulled through.

A new lifeline can then be installed. The inner portion 151 of the bumper portion 140 is also replaced with the new, replacement lifeline. The first end of the new lifeline, without a stop member, is threaded through the outer portion 141 of the bumper portion 140, through the bottom aperture 112, through the channel 122, and through the top bore 108. Again, because the stop member is not connected to the first end of the new lifeline, the first end can move past the shoulder portion 123. With the first end extending through the top bore and out of the top of the housing, the stop member is connected to the threaded end. The lifeline is then pulled in a downward direction so that the first end moves through the top bore and into the channel portion of the drum and the stop member contacts the shoulder portion 123. The tool is then inserted through the side bore 110 and into the tool receiver 126 of the set screw 125. The tool is then rotated to move the set screw 125 out of the receiving bore 117 of the housing 101 and into the cavity of the drum, which unlocks the drum 118 thereby allowing the drum 118 to rotate. The set screw 125 extends into the channel portion of the drum 118 and thus prevents the first end 131 of the lifeline 130 from being moved in an upward direction. If the stop member is not tight enough, the stop member will preferably prevent movement of the set screw 125 into the channel portion of the drum 118. The new lifeline can then be retracted into the housing and wound about the drum. The new inner portion 151 can be connected to the outer portion 141 any time during the replacement of the new lifeline.

It is recognized that a replaceable lifeline and a reserve lifeline portion could be used in the same self-retracting lifeline device or could be used individually in a variety of different self-retracting lifelines or other suitable devices.

The above specification, examples, and data provide a complete description of the manufacture and use of the composition of embodiments of the invention. Since many embodiments of the invention can be made without departing from the spirit and scope of the invention, the invention resides in the claims hereinafter appended.

I claim:

1. A self-retracting lifeline, comprising:

a housing;

a drum rotatably operatively connected to the housing;

a lifeline having a first end operatively connected to the drum, an intermediate portion windable about the drum, and a second end;

a stop member operatively connected to the intermediate portion a distance from the first end; and a bumper portion operatively connected to the housing, the bumper portion including a bore through which the lifeline extends, the bore being smaller than the stop member to prevent passage of the stop member through the bore and out of the housing, at least a portion of the bumper portion disconnecting from the housing when a force of at least 450 pounds is exerted on the bumper portion to allow passage of the stop member out of the housing.

2. The self-retracting lifeline of claim 1, wherein the distance is 2 to 4 feet.

3. The self-retracting lifeline of claim 1, wherein the bumper portion includes an outer portion operatively connected to the housing and an inner portion operatively connected to the outer portion, the outer portion having a first bore configured and arranged to receive the inner portion, the inner portion having a second bore through which the lifeline extends, the stop member being smaller than the first bore and larger than the second bore, the inner portion disconnecting from the outer portion when a force of at least 450 pounds is exerted on the inner portion to allow passage of the stop member out of the housing.

4. The self-retracting lifeline of claim 3, further comprising a pin connecting the outer portion and the inner portion, wherein the pin breaks to disconnect the outer portion and the inner portion.

5. The self-retracting lifeline of claim 3, further comprising a spring placing a biasing force on the outer portion and the inner portion and exerting a downward force on the inner portion relative to the outer portion, wherein the spring absorbs energy from an upward force placed on the inner portion.

6. The self-retracting lifeline of claim 5, further comprising a lifeline bumper operatively connected to the lifeline proximate the second end, at least a portion of the lifeline bumper being configured and arranged to be received in at least a portion of the inner portion.

7. A self-retracting lifeline, comprising:

a housing;

a drum rotatably operatively connected to the housing;

a lifeline having a first end operatively connected to the drum, an intermediate portion windable about the drum, and a second end;

a stop member operatively connected to the intermediate portion a distance from the first end; and a bumper portion operatively connected to the housing, the bumper portion including an outer portion operatively connected to the housing and an inner portion operatively connected to the outer portion, the outer portion having a first bore configured and arranged to receive the inner portion, the inner portion having a second bore through which the lifeline extends, the stop member being smaller than the first bore and larger than the second bore, the inner portion disconnecting from the outer portion when a force of at least 450 pounds is exerted on the inner portion to allow passage of the stop member out of the housing.

8. The self-retracting lifeline of claim 7, wherein the distance is 2 to 4 feet.

9. The self-retracting lifeline of claim 7, further comprising a pin connecting the outer portion and the inner portion, wherein the pin breaks to disconnect the outer portion and the inner portion.

10. The self-retracting lifeline of claim 7, further comprising a spring placing a biasing force on the outer portion and the inner portion and exerting a downward force on the inner portion relative to the outer portion, wherein the spring absorbs energy from an upward force placed on the inner portion.

11. The self-retracting lifeline of claim 10, further comprising a lifeline bumper operatively connected to the lifeline proximate the second end, at least a portion of the lifeline bumper being configured and arranged to be received in at least a portion of the inner portion.

12. A self-retracting lifeline, comprising:

a housing;

a drum rotatably operatively connected to the housing;

a lifeline having a first end operatively connected to the drum, an intermediate portion windable about the drum, and a second end;

a stop member operatively connected to the intermediate portion a distance from the first end;

a bumper portion operatively connected to the housing, the bumper portion including an outer portion operatively connected to the housing and an inner portion operatively connected to the outer portion, the outer portion having a first bore configured and arranged to receive the inner portion, the inner portion having a second bore through which the lifeline extends, the stop member being smaller than the first bore and larger than the second bore, the inner portion disconnecting from the outer portion when a force of at least 450 pounds is exerted on the inner portion to allow passage of the stop member out of the housing;

a pin connecting the outer portion and the inner portion, wherein the pin breaks to disconnect the outer portion and the inner portion; and a biasing member placing a biasing force on the outer portion and the inner portion and exerting a downward force on the inner portion relative to the outer portion, wherein the biasing member absorbs energy from an upward force placed on the inner portion.

13. The self-retracting lifeline of claim 12, wherein the distance is 2 to 4 feet.

14. The self-retracting lifeline of claim 12, further comprising a lifeline bumper operatively connected to the lifeline proximate the second end, at least a portion of the lifeline bumper being configured and arranged to be received in at least a portion of the inner portion.

15. The self-retracting lifeline of claim 12, wherein the biasing member is a spring.

* * * * *